US009316975B2

(12) United States Patent
Suzuki et al.

(10) Patent No.: US 9,316,975 B2
(45) **Date of Patent: *Apr. 19, 2016**

(54) FIXING DEVICE CAPABLE OF SUPPRESSING CONTACT BETWEEN TUBULAR MEMBER AND ELECTRIC COMPONENTS

(71) Applicant: Brother Kogyo Kabushiki Kaisha, Nagoya-shi, Aichi-ken (JP)

(72) Inventors: Noboru Suzuki, Komaki (JP); Kei Ishida, Nagoya (JP); Takuji Matsuno, Ichinomiya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/594,676

(22) Filed: Jan. 12, 2015

(65) Prior Publication Data

US 2015/0132036 A1 May 14, 2015

Related U.S. Application Data

(63) Continuation of application No. 13/426,944, filed on Mar. 22, 2012, now Pat. No. 9,037,057.

(30) Foreign Application Priority Data

May 31, 2011 (JP) ..... 2011-122830

(51) Int. Cl.

| | |
|---|---|
| ***G03G 15/20*** | (2006.01) |
| *G03G 21/16* | (2006.01) |
| *G03G 15/00* | (2006.01) |

(52) U.S. Cl.

CPC ..... *G03G 15/2053* (2013.01); *G03G 15/2085* (2013.01); *G03G 15/2017* (2013.01); (Continued)

(58) Field of Classification Search

CPC ..... G03G 15/80; G03G 21/1652; G03G 2221/166

USPC ..... 399/329

See application file for complete search history.

(56) References Cited

U.S. PATENT DOCUMENTS

| | | | |
|---|---|---|---|
| 5,742,878 | A | 4/1998 | Kuroda |
| 5,828,035 | A | 10/1998 | Kuroda |

(Continued)

FOREIGN PATENT DOCUMENTS

| | | | |
|---|---|---|---|
| JP | 06-003982 | | 1/1994 |
| JP | H06337602 | A | 12/1994 |

(Continued)

OTHER PUBLICATIONS

Feb. 10, 2015—(JP) Office Action—App 2011-122830.

(Continued)

*Primary Examiner* — David Gray
*Assistant Examiner* — Tyler Hardman
(74) *Attorney, Agent, or Firm* — Banner & Witcoff, Ltd.

(57) ABSTRACT

A fixing device for thermally fixing a developing agent image to a sheet includes: a flexible tubular member having an inner peripheral surface and circularly moving in a moving direction while the developing agent image is thermally fixed; a heater; a nip member being in sliding contact with the tubular member; a backup member nipping the tubular member in cooperation with the nip member; a stay covering the heater and supporting the nip member; an electric component positioned opposite to the heater with respect to the stay; and a frame supporting the electric component. The frame includes: an isolating portion interposed between the tubular member and the electric component for isolating the electric component from the tubular member; and a guide portion guiding the inner peripheral surface of the tubular member while the flexible tubular member is moving in the moving direction.

20 Claims, 7 Drawing Sheets

(52) U.S. Cl.
CPC ..... *G03G15/80* (2013.01); *G03G 21/1652* (2013.01); *G03G 2215/2035* (2013.01); *G03G 2221/166* (2013.01)

(56) References Cited

U.S. PATENT DOCUMENTS

| | | | | |
|---|---|---|---|---|
| 6,014,539 | A | 1/2000 | Sano et al. | |
| 6,944,420 | B2 | 9/2005 | Kanamori et al. | |
| 7,209,696 | B2 | 4/2007 | Umezawa et al. | |
| 7,235,761 | B1 | 6/2007 | Maul et al. | |
| 7,242,895 | B2 | 7/2007 | Inada et al. | |
| 7,294,810 | B1 | 11/2007 | Haseba et al. | |
| 7,792,476 | B2 | 9/2010 | Seol et al. | |
| 7,881,650 | B2 | 2/2011 | Shin et al. | |
| 8,032,069 | B2 | 10/2011 | Shin et al. | |
| 8,135,323 | B2 | 3/2012 | Suzuki et al. | |
| 8,385,801 | B2 | 2/2013 | Sugaya | |
| 8,452,218 | B2 | 5/2013 | Fujiwara et al. | |
| 8,509,667 | B2 | 8/2013 | Miyauchi | |
| 8,559,862 | B2 | 10/2013 | Kondo et al. | |
| 8,611,802 | B2 | 12/2013 | Suzuki et al. | |
| 8,725,038 | B2 | 5/2014 | Yamaguchi et al. | |
| RE45,015 | E | 7/2014 | Uchida et al. | |
| 9,037,057 | B2 * | 5/2015 | Suzuki et al. | 399/329 |
| 2003/0206756 | A1 | 11/2003 | Kanamori et al. | |
| 2005/0089787 | A1 | 4/2005 | Uchinokura et al. | |
| 2005/0163540 | A1 | 7/2005 | Umezawa et al. | |
| 2006/0133868 | A1 | 6/2006 | Kobayashi et al. | |
| 2006/0233575 | A1 | 10/2006 | Uchida et al. | |
| 2007/0053712 | A1 * | 3/2007 | Fujiwara et al. | 399/88 |
| 2008/0056783 | A1 | 3/2008 | Yamamoto et al. | |
| 2008/0232870 | A1 | 9/2008 | Ardery et al. | |
| 2009/0092423 | A1 | 4/2009 | Shin et al. | |
| 2009/0142113 | A1 | 6/2009 | Kajita et al. | |
| 2009/0208264 | A1 | 8/2009 | Fujiwara et al. | |
| 2009/0257794 | A1 | 10/2009 | Kaino et al. | |
| 2011/0058862 | A1 * | 3/2011 | Yamaguchi et al. | 399/329 |
| 2011/0058864 | A1 | 3/2011 | Fujimoto et al. | |
| 2011/0129267 | A1 | 6/2011 | Arimoto et al. | |
| 2011/0164905 | A1 | 7/2011 | Kondo et al. | |
| 2011/0164906 | A1 | 7/2011 | Ishida et al. | |
| 2011/0170919 | A1 | 7/2011 | Fujiwara et al. | |
| 2011/0170920 | A1 | 7/2011 | Fujiwara et al. | |
| 2011/0188908 | A1 | 8/2011 | Ishida et al. | |
| 2011/0194882 | A1 | 8/2011 | Kitano et al. | |
| 2011/0206406 | A1 | 8/2011 | Suzuki et al. | |
| 2011/0211881 | A1 * | 9/2011 | Suzuki et al. | 399/329 |
| 2011/0211882 | A1 | 9/2011 | Suzuki et al. | |
| 2011/0318074 | A1 | 12/2011 | Hiramatsu | |
| 2012/0163882 | A1 | 6/2012 | Kim et al. | |
| 2012/0163885 | A1 | 6/2012 | Ishida | |
| 2012/0251138 | A1 | 10/2012 | Ishida et al. | |
| 2012/0251207 | A1 | 10/2012 | Ishida et al. | |
| 2012/0269562 | A1 | 10/2012 | Hashimoto | |
| 2013/0315640 | A1 | 11/2013 | Miyauchi | |
| 2013/0322937 | A1 | 12/2013 | Suzuki et al. | |
| 2013/0322939 | A1 | 12/2013 | Ishida et al. | |
| 2014/0140715 | A1 | 5/2014 | Ishida et al. | |

FOREIGN PATENT DOCUMENTS

| | | | | |
|---|---|---|---|---|
| JP | 08-006409 | | | 1/1996 |
| JP | H0863019 | A | | 3/1996 |
| JP | 09-127809 | | | 5/1997 |
| JP | 10-247026 | | | 9/1998 |
| JP | 2001-147605 | A | | 5/2001 |
| JP | 2001-356623 | A | | 12/2001 |
| JP | 2003-316180 | A | | 11/2003 |
| JP | 2005-157032 | A | | 6/2005 |
| JP | 2005-166299 | A | | 6/2005 |
| JP | 2006-047769 | A | | 2/2006 |
| JP | 2007-047388 | A | | 2/2007 |
| JP | 2008-233886 | A | | 10/2008 |
| JP | 2009-053507 | A | | 3/2009 |
| JP | 2011128299 | A | * | 6/2011 |
| JP | 2011-170239 | A | | 9/2011 |

OTHER PUBLICATIONS

Non-Final Office Action received in U.S. Appl. No. 13/426,878 mailed Oct. 1, 2013.

Non-final Office Action issue U.S. Appl. No. 13/426,816 mailed Dec. 18, 2013.

Notice of Allowance issued in U.S. Appl. No. 13/426,878 mailed Apr. 17, 2014.

Non-Final Office Action received in corresponding U.S. Appl. No. 13/426,784 mailed Jun. 5, 2014.

Co-pending U.S. Appl. No. 13/426,816, filed Mar. 22, 2012.

Co-pending U.S. Appl. No. 13/426,944, filed Mar. 22, 2012.

Co-pending U.S. Appl. No. 13/426,784, filed Mar. 22, 2012.

Notice of Allowance issued in corresponding U.S. Appl. No. 13/426,878 mailed Jul. 21, 2014.

Aug. 11, 2014—(US) Notice of Allowance—U.S. Appl. No. 13/426,816.

* cited by examiner

FIXING DEVICE CAPABLE OF SUPPRESSING CONTACT BETWEEN TUBULAR MEMBER AND ELECTRIC COMPONENTS

CROSS REFERENCE TO RELATED APPLICATION

This application is a continuation application of U.S. application Ser. No. 13/426,944 filed Mar. 22, 2012 which claims priority from Japanese Patent Application No. 2011-122830 filed May 31, 2011. The entire contents of the above noted applications are incorporated herein by reference.

TECHNICAL FIELD

The present invention relates to a fixing device that thermally fixes a transferred developing agent image to a sheet.

BACKGROUND

A conventional thermal fixing device used in an electrophotographic image forming apparatus includes an endless fixing belt (tubular member), a halogen lamp (heater) disposed at an inner space defined by an inner peripheral surface of the tubular member, a pressing pad that slidably contacts the inner peripheral surface of the tubular member, and a pressure roller that nips the tubular member in cooperation with the pressing pad.

SUMMARY

The above-described fixing device requires a temperature sensor for controlling the heater and electric components including wires connected to the temperature sensor and the heater. When such temperature sensor and the electric components are disposed at the internal space defined by the inner peripheral surface of the tubular member, the internal peripheral surface of the tubular member may possibly contact the temperature sensor and/or the electric components, while the tubular member is circulary moved.

In view of the foregoing, it is an object of the present invention to provide a fixing device capable of suppressing contact between a tubular member and electric components disposed at an internal space defined by the tubular member.

In order to attain the above and other objects, there is provided a fixing device for thermally fixing a developing agent image to a sheet. The fixing device includes: a flexible tubular member having an inner peripheral surface defining an internal space, the flexible tubular member circularly moving in a moving direction while the developing agent image is thermally fixed; a heater disposed at the internal space; a nip member disposed at the internal space and configured to be in sliding contact with the inner peripheral surface of the flexible tubular member; a backup member configured to nip the flexible tubular member in cooperation with the nip member to provide a nip region; a stay disposed at the internal space to cover the heater and configured to support the nip member; an electric component disposed at the internal space and positioned opposite to the heater with respect to the stay; and a frame disposed at the internal space to support the electric component. The frame includes: an isolating portion interposed between the tubular member and the electric component and configured to isolate the electric component from the tubular member; and a guide portion configured to guide the inner peripheral surface of the flexible tubular member while the flexible tubular member is moving in the moving direction.

DETAILED DESCRIPTION

First, a general configuration of a laser printer 1 incorporating a fixing device 100 according to an embodiment of the present invention will be described with reference to FIG. 1. In the following description, a general structure of the laser printer 1 will be described first and a detailed structure of the fixing device 100 will be then described.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side of the laser printer 1 are referred to as a front side, a rear side, a left side and a right side, respectively.

Figure 1:
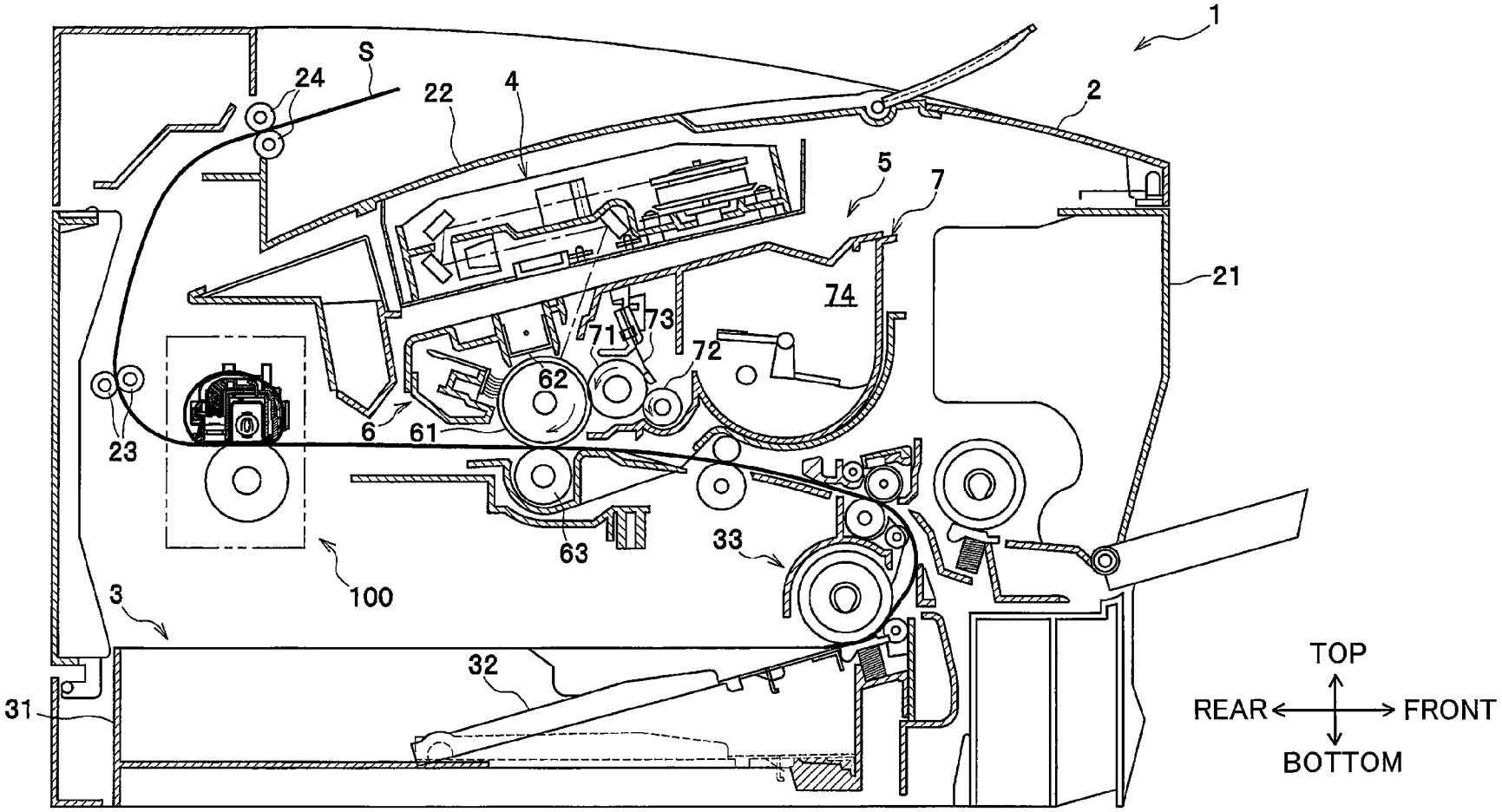
FIG. 1 is a schematic cross-sectional view illustrating a general configuration of a laser printer provided with a fixing device according to an embodiment of the present invention.

As shown in FIG. 1, the laser printer 1 includes a main frame 2 provided with a movable front cover 21. Within the main frame 2, a sheet supply unit 3 for supplying a sheet S, an exposure unit 4, a process cartridge 5 for transferring a toner image (developing agent image) on the sheet S, and the fixing device 100 for thermally fixing the toner image onto the sheet S are provided.

The sheet supply unit 3 is disposed at a lower portion of the main frame 2. The sheet supply unit 3 includes a sheet supply tray 31 for accommodating the sheet S, a lifter plate 32 for lifting up a front side of the sheet S, a sheet conveying mechanism 33. Each sheet S accommodated in the sheet supply tray 31 is lifted upward by the lifter plate 32, and is conveyed toward the process cartridge 5 by the sheet conveying mechanism 33.

The exposure unit 4 is disposed at an upper portion of the main frame 2. The exposure unit 4 includes a laser emission unit (not shown), a polygon mirror, lenses and reflection mirrors (shown without reference numerals). In the exposure unit 4, the laser emission unit emits a laser beam (indicated by a chain line in FIG. 1) based on image data such that a surface of a photosensitive drum 61 (described later) is exposed by high speed scanning of the laser beam.

The process cartridge 5 is disposed below the exposure unit 4. The process cartridge 5 is detachably loadable in the main frame 2 through an opening defined when the front cover 21 of the main frame 2 is opened. The process cartridge 5 includes a drum unit 6 and a developing unit 7.

The drum unit 6 includes the photosensitive drum 61, a charger 62, and a transfer roller 63. The developing unit 7 is detachably mounted on the drum unit 6. The developing unit 7 includes a developing roller 71, a supply roller 72, a thickness-regulation blade 73, and a toner accommodating portion 74 in which toner (developing agent) is accommodated.

In the process cartridge 5, after the surface of the photosensitive drum 61 has been uniformly charged by the charger 62, the surface is exposed to the high speed scanning of the laser beam from the exposure unit 4. An electrostatic latent image based on the image data is thereby formed on the surface of the photosensitive drum 61. The toner accommodated in the toner accommodating portion 74 is supplied to the developing roller 71 via the supply roller 72. The toner then enters between the developing roller 71 and the thickness-regulation blade 73 to be carried on the developing roller 71 as a thin layer having a uniform thickness.

The toner borne on the developing roller 71 is supplied to the electrostatic latent image formed on the photosensitive drum 61, thereby developing the electrostatic latent image into a visible toner image. The toner image is thus formed on the surface of the photosensitive drum 61. Subsequently, when the sheet S is conveyed between the photosensitive drum 61 and the transfer roller 63, the toner image formed on the photosensitive drum 61 is transferred onto the sheet S.

The fixing device 100 is disposed rearward of the process cartridge 5. The toner image (toner) transferred onto the sheet S is thermally fixed on the sheet S while the sheet S passes through the fixing device 100. The sheet S on which the toner image has been thermally fixed is then conveyed by conveying rollers 23, 24 to be discharged onto a discharge tray 22 formed on an upper surface of the main frame 2.

Next, a detailed structure of the fixing device 100 according to the embodiment of the present invention will be described with reference to FIGS. 2 through 7.

Figure 2:
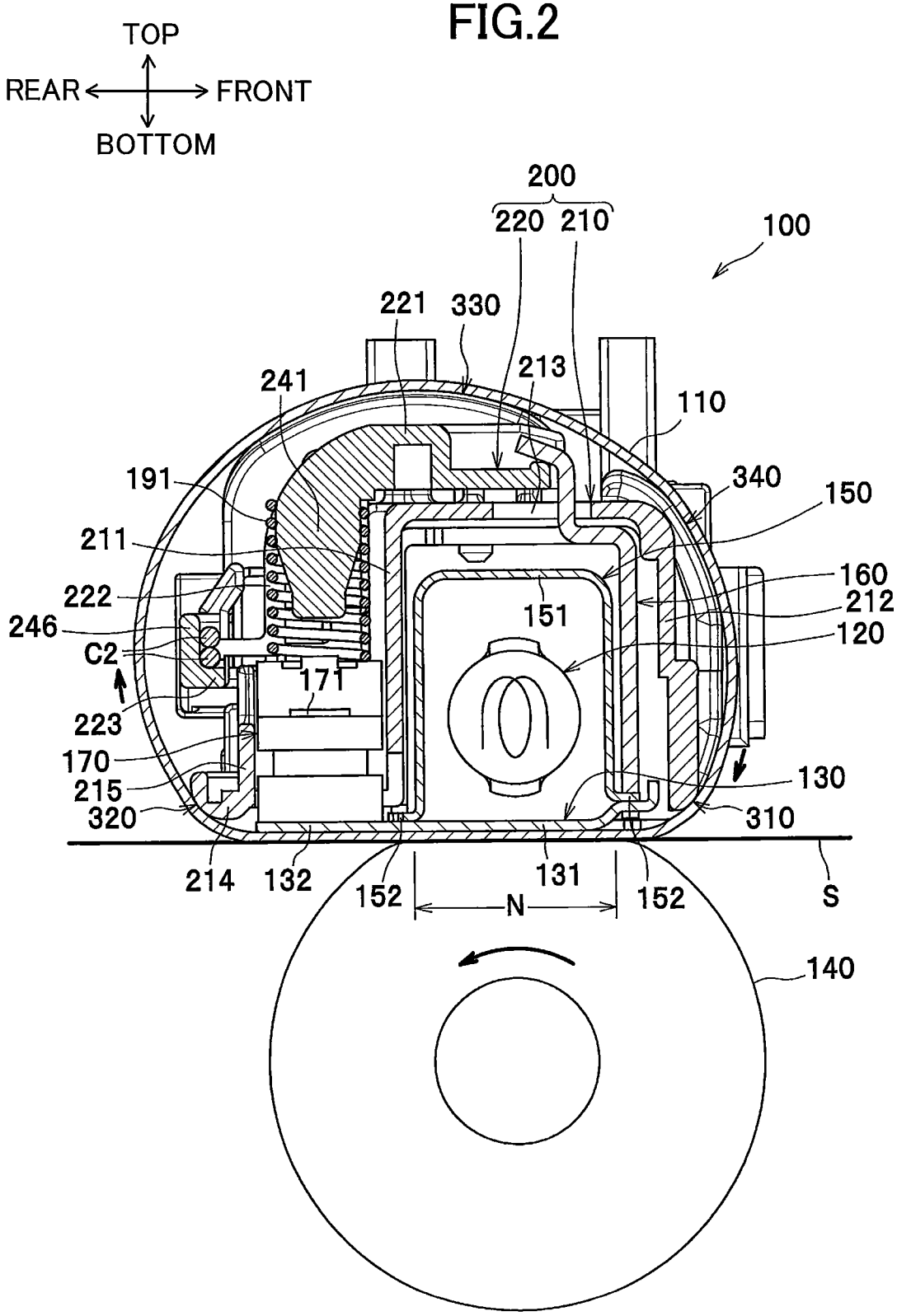
FIG. 2 is a schematic cross-sectional view of the fixing device according to the embodiment taken along a plane in which a thermostat of the fixing device is included.

As shown in FIG. 2, the fixing device 100 includes a flexible fusing belt 110 as a tubular member, a halogen lamp 120 as a heater, a nip plate 130 as a nip member, a pressure roller 140 as a backup member, a reflection member 150, a stay 160, a thermostat 170 and two thermistors 180 as a temperature sensor (see FIGS. 3, 4), cables C1 and C2 (see FIG. 5), and a frame 200 (a first frame 210 and a second frame 220).

In the present embodiment, the thermostat 170, thermistors 180, the cables C1 and the cable C2 are examples of electric components.

The fusing belt 110 is of an endless belt (of a tubular configuration) having heat resistivity and flexibility. The fusing belt 110 has an inner peripheral surface that defines an internal space within which the halogen lamp 120, the nip plate 130, the reflection member 150, the stay 160 and the frame 200 are disposed. The fusing belt 110 extends in a left-to-right direction (see FIG. 7). Hereinafter, the left-to-right direction in which the fusing belt 110 extends may also be referred to as an axial direction of the fusing belt 110, wherever necessary. The fusing belt 110 has widthwise end portions that are guided by guide portions formed on the frame 200 (an upstream guide 310, a downstream guide 320, an upper guide 330 and a front guide 340 which will be described later) so that the fusing belt 110 is circularly movable. In the embodiment, the fusing belt 110 is made from a metal, for example, a stainless steel or nickel.

The halogen lamp 120 is a heater to generate radiant heat to heat the nip plate 130 and the fusing belt 110 (nip region N, see FIG. 2) for heating toner on the sheet S. The halogen lamp 120 is positioned at the internal space of the fusing belt 110 such that the halogen lamp 120 is spaced away from an inner surface of the nip plate 130 by a predetermined distance.

Figure 3:
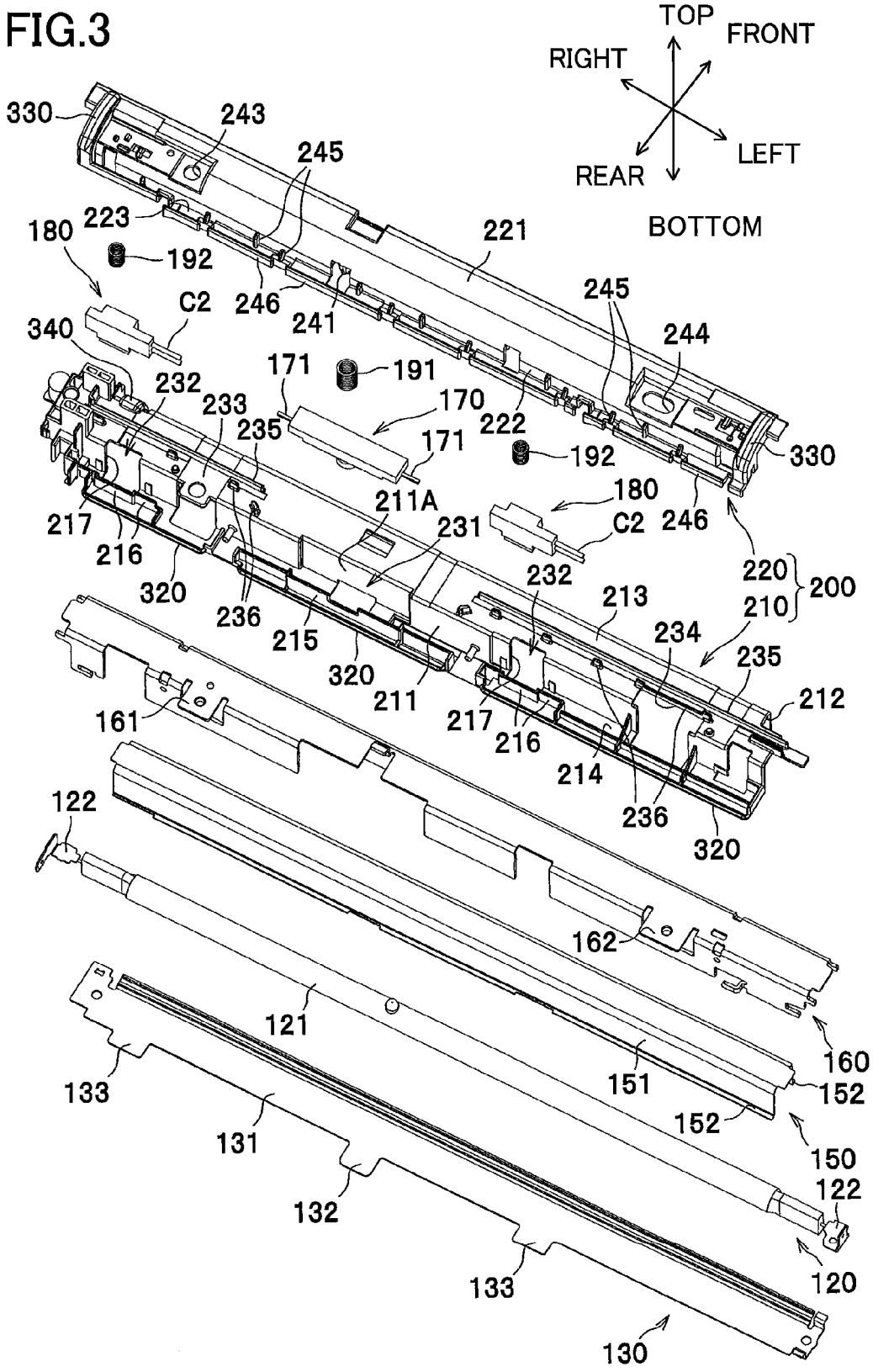
FIG. 3 is an exploded perspective view of the fixing device according to the embodiment, the fixing device including a nip plate, a halogen lamp, a reflection member, a stay, a first frame, the thermostat, thermistors and a second frame, the fixing device extending in a left-to-right direction.

As shown in FIG. 3, the halogen lamp 120 includes a cylindrical-shaped glass tube 121 extending in the left-to-right direction, and a filament (not shown) disposed at an internal space of the glass tube 121. Inert gas including halogen is sealed within the glass tube 121. The halogen lamp 120 has widthwise end portions on each of which an electrode 122 is provided. Each electrode 122 is electrically connected to each widthwise end of the filament disposed within the glass tube 121.

The nip plate 130 has a plate-like shape and is adapted to receive radiant heat from the halogen lamp 120. To this effect, the nip plate 130 is positioned at the internal space of the fusing belt 110 such that the inner peripheral surface of the fusing belt 110 is slidably movable with a lower surface of the nip plate 130. The nip plate 130 is made from a metal. In the embodiment, the nip plate 130 is made of aluminum having a thermal conductivity higher than that of the stay 160 (described later) made from a steel. For fabricating the nip plate 130, an aluminum plate is bent to provide a base portion 131, a first protruding portion 132, and two second protruding portions 133, as shown in FIG. 3.

The base portion 131 is flat and extends in the left-to-right direction. The base portion 131 has a lower surface that is in sliding contact with the inner peripheral surface of the fusing belt 110. The base portion 131 transmits the radiant heat from the halogen lamp 120 to the toner on the sheet S via the fusing belt 110.

The base portion 131 has a rear end portion from which the first protruding portion 132 and the two second protruding portions 133 protrude rearward respectively. Each of the first protruding portion 132 and the second protruding portions 133 has a substantially flat plate-like shape.

The first protruding portion 132 is formed at a position adjacent to a lateral center of the rear end portion of the base portion 131 in the left-to-right direction. The first protruding portion 132 has an upper surface on which the thermostat 170 is disposed to confront the same, and a lower surface that faces the pressure roller 140.

The two second protruding portions 133 are formed such that one of the second protruding portions 133 is arranged at a position adjacent to a right end portion of the rear end portion of the base portion 131, while the other second protruding portion 133 is arranged at a position adjacent to the lateral center of the rear end portion but leftward of the first protruding portion 132 in the left-to-right direction. Each second protruding portion 133 has an upper surface on which one of the two thermistors 180 is disposed to face the same.

The pressure roller 140 is disposed below the nip plate 130 such that the pressure roller 140 nips the fusing belt 110 in cooperation with the nip plate 130, as shown in FIG. 2. The pressure roller 140 is configured to rotate upon receipt of a driving force transmitted from a motor (not shown) disposed within the main frame 2. As the pressure roller 140 rotates, the fusing belt 110 is circularly moved along the nip plate 130 because of a friction force generated between the pressure roller 140 and the fusing belt 110 or between the sheet S and the fusing belt 110. The toner image on the sheet S can be thermally fixed thereto by heat and pressure during passage of the sheet S between the pressure roller 140 and the fusing belt 110 (the nip region N).

The reflection member 150 is adapted to reflect radiant heat from the halogen lamp 120 toward the nip plate 130. As shown in FIG. 2, the reflection member 150 is positioned at the internal space of fusing belt 110 to surround the halogen lamp 120 with a predetermined distance therefrom. Thus, heat from the halogen lamp 120 can be efficiently concentrated onto the nip plate 130 to promptly heat the nip plate 130 and the fusing belt 110.

The reflection member 150 has a U-shaped cross-section and is made from a material such as aluminum having high reflection ratio regarding infrared ray and far infrared ray. Specifically, the reflection member 150 has a U-shaped reflection portion 151 and two flange portions 152 each extending outward (frontward or rearward) from each end portion of the reflection portion 151 in the front-to-rear direction.

The stay 160 is adapted to support the nip plate 130 via the flange portions 152 at the internal space of the fusing belt 110 for receiving load applied from the pressure roller 140. Here, the load applied from the pressure roller 140 refers to a reaction force generated in response to a force with which the nip plate 130 biases the pressure roller 140.

The stay 160 has a U-shaped configuration in conformity with an outer profile of the U-shaped reflection member 150 for covering the reflection member 150 and the halogen lamp 120. For fabricating the stay 160, a highly rigid member such as a steel plate is folded into U-shape. As shown in FIG. 3, the stay 160 has an upper wall on which a right fixing portion 161 and a left fixing portion 162 are formed such that each of the right fixing portion 161 and the left fixing portion 162 protrudes rearward from the upper wall of the stay 160. The right fixing portion 161 and the left fixing portion 162 are formed at positions separated from each other in the left-to-right direction. Each of the right and left fixing portions 161, 162 is formed with a screw hole (shown without reference numerals).

The thermostat 170 includes a bimetal (not shown) and is configured to shut down power supply to the halogen lamp 120 when a predetermined temperature is detected. As shown in FIG. 2, the thermostat 170 is disposed at the internal space of the fusing belt 110 such that the thermostat 170 confronts the halogen lamp 120 via the reflection member 150 and the stay 160 (i.e., the thermostat 170 is disposed outside of the stay 160).

More specifically, the thermostat 170 has a lower surface that opposes the upper surface of the first protruding portion 132 of the nip plate 130. The lower surface of the thermostat 170 serves as a temperature detecting surface. As described above, the first protruding portion 132 extends directly from the base portion 131 that nips the fusing belt 110 (and the sheet S) in cooperation with the pressure roller 140. Therefore, the thermostat 170 opposing the first protruding portion 132 can detect a temperature of the nip plate 130 and in the vicinity of the nip region N with accuracy.

The thermostat 170 is provided with a pair of electrodes 171 each extending outward from each end portion of the thermostat 170 in the left-to-right direction (FIG. 3). The electrode 171 has a flat plate-like shape (see FIG. 2).

The thermistors 180 are temperature sensors configured to detect the temperature of the nip plate 130. The two thermistors 180 are disposed at the internal space of the fusing belt 110 such that each thermistor 180 confronts the halogen lamp 120 via the reflection member 150 and the stay 160, as shown in FIG. 4.

More specifically, each thermistor 180 has a lower surface opposing the upper surface of each second protruding portion 133 of the nip plate 130. The lower surface of each thermistor 180 serves as a temperature detecting surface. Since the second protruding portions 133 also extend directly from the base portion 131, the thermistor 180 facing the second protruding portion 133 can detect the temperature of the nip plate 130 and in the vicinity of the nip region N with accuracy.

Figure 4:
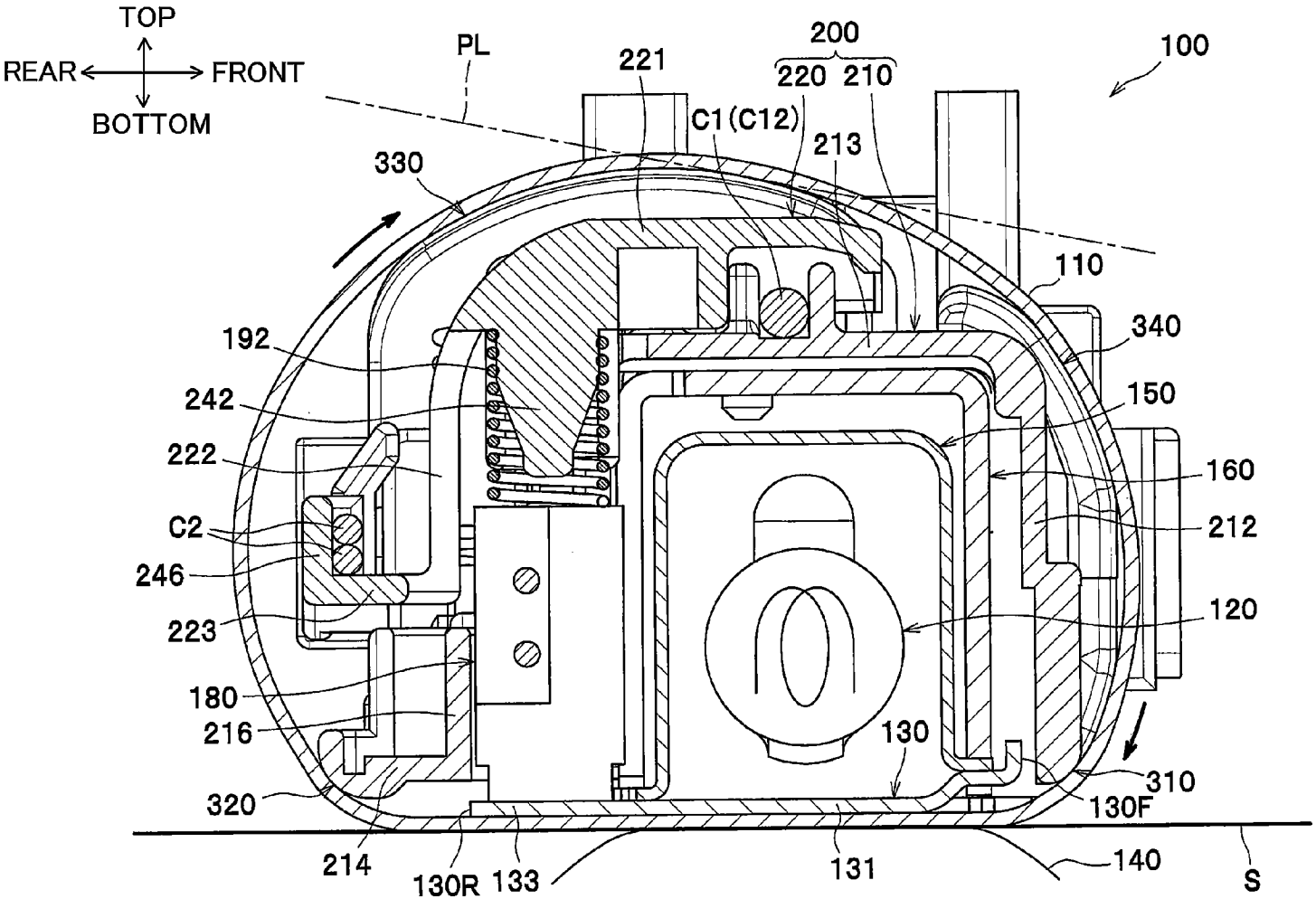
FIG. 4 is an enlarged cross-sectional view of the fixing device taken along a plane in which one of the thermistors positioned substantially center in the left-to-right direction is included.

As shown in FIGS. 2 and 4, the thermostat 170 and the two thermistors 180 are respectively biased, by coil springs 191 and 192, toward the first protruding portion 132 and the second protruding portions 133. With this construction, the thermostat 170 and the thermistors 180 can be stably positioned relative to the nip plate 130, which is subject to detection, thereby the temperature of the nip plate 130 and in the vicinity of the nip region N with further accuracy.

Figure 5:
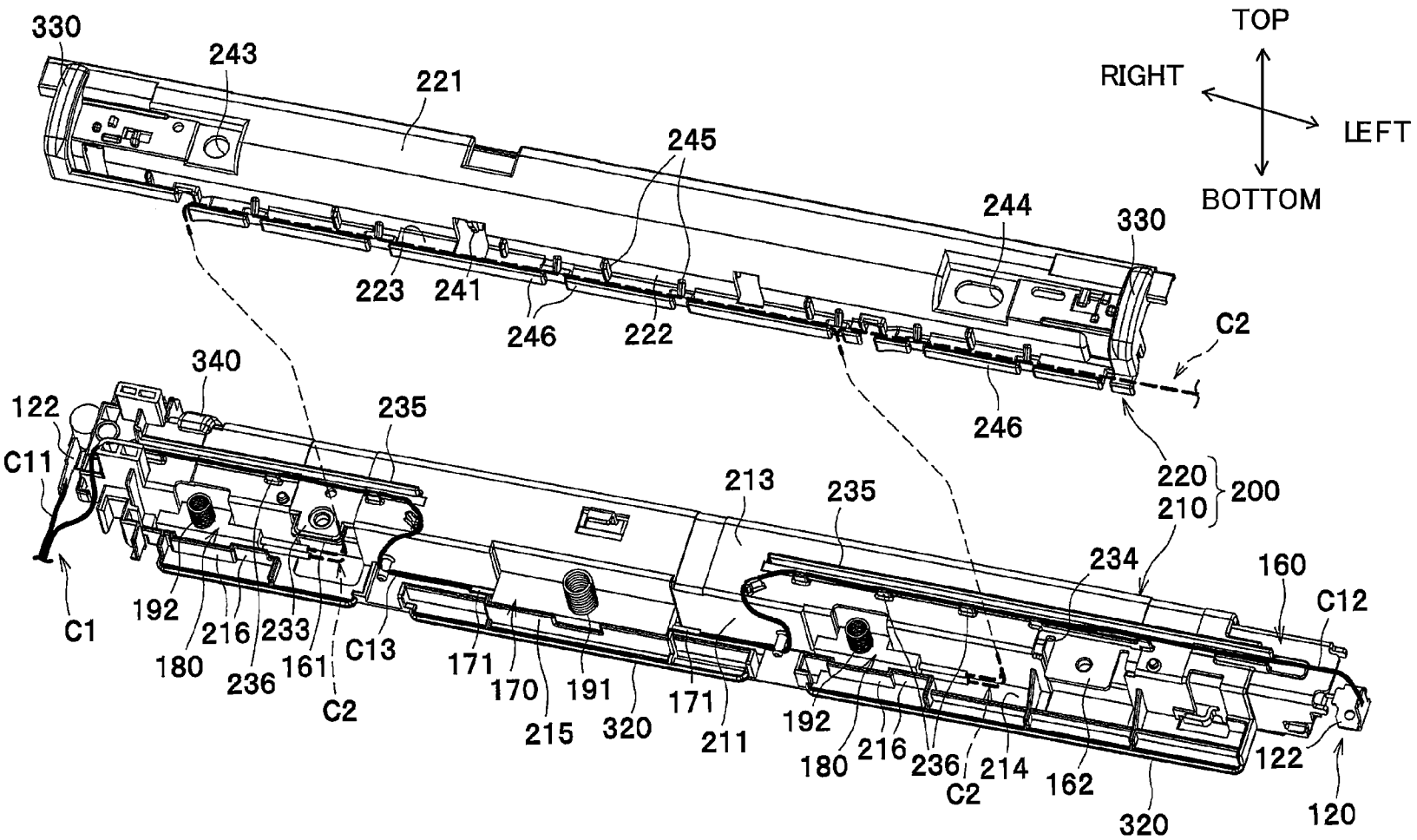
FIG. 5 is a perspective view of the first frame and the second frame, explaining how wirings are arranged on the first frame and the second frame, the second frame including a right fixing portion and a left fixing portion.

The cable C1 is a wiring for supplying power to the halogen lamp 120 (shown in a thick solid line in FIG. 5). The cable C1 is disposed at the internal space of the fusing belt 110 such that the cable C1 is placed at a side opposite to the halogen lamp 120 with respect to the stay 160 (see FIG. 4). This cable C1 is connected to the halogen lamp 120 and the thermostat 170.

Specifically, the cable C1 is configured of a lead wire C11, a lead wire C12 and a lead wire C13. The lead wire C11 is connected to the rightward electrode 122 of the halogen lamp 120, and the lead wires C12, C13 are connected to the leftward electrode 122 of the halogen lamp 120 directly or indirectly.

As shown in FIG. 5, the lead wire C12 extends, from the leftward electrode 122 of the halogen lamp 120, rightward along an upper wall 213 (described later) of the first frame 210. The lead wire C12 then extends downward along a rear wall 211 (described later) of the first frame 210 at a position adjacent to a lateral center of the first frame 210 in the left-to-right direction, and is finally connected to the leftward electrode 171 of the thermostat 170.

The lead wire C13 connected to the rightward electrode 171 of the thermostat 170 extends first upward along the rear wall 211, then rightward along the upper wall 213 of the first frame 210, and is drawn from a right end portion of the fusing belt 110 together with the lead wire C11.

An end of the cable C1, which is drawn out of the right end portion of the fusing belt 110, is connected to an electric circuit board (not shown) disposed within the main frame 2. In this way, power supply to the halogen lamp 120 is realized. Since the thermostat 170 is connected to the cable C1 such that the thermostat 170 is positioned midway of an entire length of the cable C1, the thermostat 170 can shut off the power supply to the halogen lamp 120 immediately in case of the nip plate 130 being overheated.

The cable C2 shown in a thick broken line in FIG. 5 is a wiring connected to the thermistors 180. Similar to the cable C1, the cable C2 is disposed at the side opposite to the halogen lamp 120 with respect to the stay 160 (see FIG. 4).

Specifically, the cable C2 is connected to a thermistor element (not shown) disposed within the main frame 2, and is drawn from a left end portion of a casing of each thermistor 180. The cable C2 coming from each thermistor 180 extends upward and then leftward along a rear wall 222 (described later) of the second frame 220 and is drawn out of a left end portion of the fusing belt 110.

An end of the cable C2 drawn from the left end portion of the fusing belt 110 is connected to a control circuit board (not shown) disposed within the main frame 2. In this way, detection results of the thermistors 180 are outputted to the control circuit board for controlling operations of the halogen lamp 120.

The frame 200 is adapted to support the thermostat 170, thermistors 180 and the cables C1, C2 as the electric components.

The frame 200 is disposed at the internal space of the fusing belt 110 so as to cover the stay 160, as shown in FIG. 2. The frame 200 includes the first frame 210 and the second frame 220, as shown in FIG. 3.

The first frame 210 is disposed at the internal space of the fusing belt 110 such that the first frame 210 is positioned at a side opposite to the halogen lamp 120 with respect to the stay 160 (see FIGS. 2 to 4). The first frame 210 has a substantially U-shaped cross-section for covering the stay 160. The first frame 210 extends in the left-to-right direction such that the thermostat 170, the thermistors 180 and the cable C1 are supported at an entire length of the first frame 210 in the axial direction.

In the embodiment, the first frame 210 is formed of an electrically insulative material, such as a liquid crystal polymer, a PEEK resin (polyether ether ketone resin), or a PPS resin (polyphenylene sulfide resin). The first frame 210 has the rear wall 211 that is interposed between the electrode 171 of the thermostat 170 and electrically conductive members (the reflection member 150 and the stay 160). That is, the rear wall 211 serves to secure electrical insulation between the electrode 171 and the 150 and the 150 or the stay 160.

As shown in FIG. 3, the first frame 210 includes the rear wall 211, a front wall 212, the upper wall 213 connecting between upper end portions of the rear wall 211 and the front wall 212, and a supporting wall 214 extending rearward from a bottom end portion of the rear wall 211. Further, the first frame 210 is formed with a first positioning portion 231, two second positioning portions 232, a fixing portion 233, a cutout portion 234, a rib 235 and a rib 236.

The first positioning portion 231 serves to position the thermostat 170. The first positioning portion 231 is configured of a recessed portion 211A and a sectional wall 215. The recessed portion 211A is formed on the rear wall 211 at a position adjacent to a lateral center of the rear wall 211 in the left-to-right direction. The sectional wall 215 is erected to oppose the recessed portion 211A in the front-to-rear direction and has a substantially U-shape in a plan view (see FIGS. 3 and 5). The first positioning portion 231 is a space defined by the recessed portion 211A and the sectional wall 215. The thermostat 170 is placed at the first positioning portion 231 so as to be positioned in the front-to-rear direction as well as in the left-to-right direction.

Each second positioning portion 232 serves to position each thermistor 180. Each second positioning portion 232 defined by a sectional wall 216 and a portion of the rear wall 211 opposing the sectional wall 216. Each sectional wall 216 is erected to extend upward from the supporting wall 214 such that one of the two sectional walls 216 is disposed at a position adjacent to the lateral center of the supporting wall 214 but leftward of the first positioning portion 231, and the other sectional wall 216 on a right end portion of the supporting wall 214 in the left-to-right direction. The portion of the rear wall 211 defining each second positioning portion 232 is formed with an opening 217 at a position center thereof in the left-to-right direction. Each thermistor 180 is coupled to the corresponding opening 217 such that a portion of the thermistor 180 that is convex frontward is fitted with the opening 217 (see FIG. 5). Each thermistor 180 coupled to the corresponding second positioning portion 232 is thus positioned in the front-to-rear direction as well as in the left-to-right direction.

The opening 217 is formed such that the opening 217 extends from the rear wall 211 to reach the supporting wall 214 in the front-to-rear direction. Therefore, the thermistor 180 is allowed to be exposed to the nip plate 130. Further, the first positioning portion 231 has a bottom surface on which a through-hole (shown without reference numeral in FIG. 3) is formed for permitting the thermostat 170 to be exposed to the nip plate 130.

The fixing portion 233 is formed at the upper wall 213 so as to protrude rearward therefrom at a position coincident with that of the right fixing portion 161 of the stay 160 in the left-to-right direction. The fixing portion 233 thus serves to fix the first frame 210 to the right fixing portion 161 of the stay 160. On the fixing portion 233, a through-hole having a substantially circular shape in a plan view is formed (shown without a reference numeral in FIG. 3) such that the through-hole can be coincident with the screw hole of the right fixing portion 161.

The cutout portion 234 is formed on a left end portion of the first frame 210 such that the cutout portion 234 extends the upper wall 213, the rear wall 211 and the supporting wall 214 in the front-to-rear direction. As shown in FIG. 5, when the first frame 210 is assembled to the stay 160, the left fixing portion 162 of the stay 160 is exposed from the cutout portion 234. The cutout portion 234 has a length in the left-to-right direction that is greater than that of the left fixing portion 162.

The ribs 235, 236 are provided on the upper wall 213 to protrude upward therefrom. The ribs 235 are aligned in the left-to-right direction. The ribs 236 are aligned intermittently in the left-to-right direction such that the ribs 236 oppose the ribs 235 to form a passage along which the cable C1 is arranged. The ribs 235 and the ribs 236 are arranged to face each other in the front-to-rear direction with a prescribed gap so that the cable C1 can be nipped between the ribs 235 and 236. The cable C1 is thus suppressed from moving in the front-to-rear direction on the upper wall 213.

In the embodiment, as shown in FIG. 2, the supporting wall 214 and the sectional wall 215 are located at a side (rear side) opposite to the halogen lamp 120 (front side) with respect to the thermostat 170. At the same time, the supporting wall 214 and the sectional wall 215 serve as an "isolating portion" positioned between the thermostat 170 and the fusing belt 110 for isolating the thermostat 170 from the fusing belt 110. With provision of the supporting wall 214 and the sectional wall 215 as the isolating portion, contact between the fusing belt 110 and the thermostat 170 can be suppressed.

Further, as shown in FIG. 4, the supporting wall 214 and the sectional wall 216 are disposed at a side (rear side) opposite to the halogen lamp 120 (front side) with respect to each thermistor 180. At the same time, the supporting wall 214 and the sectional wall 216 serve as an "isolating portion" positioned between the thermistor 180 and the fusing belt 110 for isolating the thermistor 180 from the fusing belt 110. Therefore, with provision of the supporting wall 214 and the sectional wall 216 as the isolating portion, contact between the fusing belt 110 and the thermistor 180 can also be suppressed.

The second frame 220 has a substantially L-shaped cross-section and extends in the left-to-right direction, as shown in FIGS. 2 and 3. The second frame 220 is disposed at a side opposite to the stay 160 with respect to the first frame 210 (via the rear wall 211 and the upper wall 213).

In the present embodiment, the second frame 220 is also made from an electrically insulative material, such as a liquid crystal polymer, a PEEK resin (polyether ether ketone resin), or a PPS resin (polyphenylene sulfide resin). The second frame 220 is adapted to support the cable C2.

The second frame 220 includes an upper wall 221, the rear wall 222, and a supporting wall 223. The rear wall 222 extends downward from a bottom end portion of the upper wall 221, and the supporting wall 223 extends rearward from a bottom end portion of the rear wall 222. As shown in FIG. 3, the second frame 220 is further formed with a first supporting portion 241, two second supporting portions 242 (only one is shown in FIG. 4), a circular hole 243, an oblong hole 244, ribs 245 and ribs 246.

The first supporting portion 241 serves to support the coil spring 191. The first supporting portion 241 extends (protrudes) downward from a lower surface of the upper wall 221 at a position adjacent to a lateral center of the upper wall 221 in the left-to-right direction (i.e., at a position corresponding to the first positioning portion 231 of the first frame 210). The coil spring 191 is coupled to the first supporting portion 241 so as to be supported to the second frame 220 (the frame 200).

Each second supporting portion 242 serves to support each coil spring 192. The second supporting portions 242 extend (protrude) downward from the lower surface of the upper wall 221 such that one of the second supporting portions 242 is arranged at a position adjacent to the lateral center of the upper wall 221 but leftward of the first supporting portion 241, and the other second supporting portion 242 is arranged at a right end portion of the upper wall 221 (i.e., at positions corresponding to those of the second positioning portions 232 of the first frame 210). The coil springs 192 are coupled to the second supporting portions 242 so as to be supported to the second frame 220 (the frame 200).

As shown in FIG. 3, the circular hole 243 is a through-hole formed at the right end portion of the upper wall 221. The circular hole 243 has a substantially circular shape in a plan view and is formed at a position corresponding to that of the screw hole of the right fixing portion 161. The oblong hole 244 is a through-hole formed at a left end portion of the upper wall 221. The oblong hole 244 has a substantially oblong shape elongated in the left-to-right direction. The oblong hole 244 is arranged at a position corresponding to that of the screw hole of the left fixing portion 162.

The ribs 245 and 246 are formed on the supporting wall 223 to protrude upward therefrom. The ribs 245 and 246 are provided intermittently in the left-to-right direction to form a passage along which the cable C2 is arranged. More specifically, as shown in FIG. 5, each rib 245 has a plate-like shape extending in front-to-rear direction and in the top-to-bottom direction. The ribs 245 are aligned in line in the left-to-right direction such that each rib 245 protrudes from the rearward from the rear wall 222 and upward from the supporting wall 223. Each rib 246 extends upward from a rear end portion of the supporting wall 223 and has a certain length in the left-to-right direction. That is, the ribs 246 are aligned in the left-to-right direction intermittently along the supporting wall 223. Each rib 246 is arranged to oppose one of the ribs 245 in the front-to-rear direction such that a gap is provided between each rib 246 and the rib 245 opposing the rib 246. The cable C2 is nipped between the ribs 245 and 246 so that the cable C2 can be suppressed from coming off from the supporting wall 223.

The second frame 220 is configured to be assembled to the first frame 210 such that particular portions of the second frame 220 can overlap with corresponding portions of the first frame 210. When the second frame 220 is assembled to the first frame 210 as designed, as shown in FIG. 4, the cable C1 is interposed between the second frame 220 (the upper wall 221) and the first frame 210 (the upper wall 213), which are overlapped with each other in a top-to-bottom direction.

Likewise, when the first frame 210 and the second frame 220 are assembled, as shown in FIGS. 2 and 4, the thermostat 170 and the thermistors 180 are disposed between the first frame 210 (the supporting wall 214) and the second frame 220 (the upper wall 221) which are overlapped with each other in the top-to-bottom direction.

In the present embodiment, as shown in FIG. 4, the upper wall 221 of the second frame 220 is positioned at a side (upper side) opposite to the halogen lamp 120 (lower side) with respect to the cable C1. At the same time, the upper wall 221 serves as an "isolating portion" positioned between the cable C1 and the fusing belt 110 for isolating the cable C1 from the fusing belt 110. In other words, the upper wall 221 is formed between the cable C1 and the fusing belt 110 so as to cover the cable C1 (a portion of the cable C1 that is disposed on the upper wall 213 of the first frame 210 and covered by the upper wall 221 of the second frame 220). With provision of the upper wall 221 as the isolating portion, contact between the fusing belt 110 and the cable C1 can be suppressed.

Further, as shown in FIG. 4, the ribs 246 of the second frame 220 are disposed at a side (rear side) opposite to the halogen lamp 120 (front side) with respect to the cable C2. At the same time, the ribs 246 serve as an "isolating portion" positioned between the cable C2 and the fusing belt 110 for isolating the cable C2 from the fusing belt 110. Therefore, with provision of the ribs 246 as the isolating portion, contact between the fusing belt 110 and the cable C2 can also be suppressed.

It should be noted that the isolating portions formed on the first frame 210 (the supporting wall 214 and the sectional walls 215, 216) and the isolating portions formed on the second frame 220 (the upper wall 221 and the ribs 246) are both formed from an electrically insulative material. Therefore, since the isolating portions can serve to suppress contact of the fusing belt 110 with the electric components such as the cables C1 and C2, insulation of the fusing belt 110 from the electric components can be secured.

Next, assembly of the stay 160, thermostat 170, the thermistors 180, coil springs 191, 192 and the frame 200 will be described.

In a state as shown in FIG. 3, the first frame 210 is assembled to the stay 160 such that the first frame 210 covers the stay 160. The thermostat 170 is then arranged on the first positioning portion 231 of the first frame 210, and each thermistor 180 is positioned on each second positioning portion 232 of the first frame 210. The coil spring 191 is then coupled to the first supporting portion 241 of the second frame 220, and each coil spring 192 is coupled to each second supporting portion 242 of the second frame 220. The second frame 220 is then assembled to the first frame 210 that has been assembled to the stay 160 such that the second frame 220 is placed over the first frame 210.

Figure 6A:
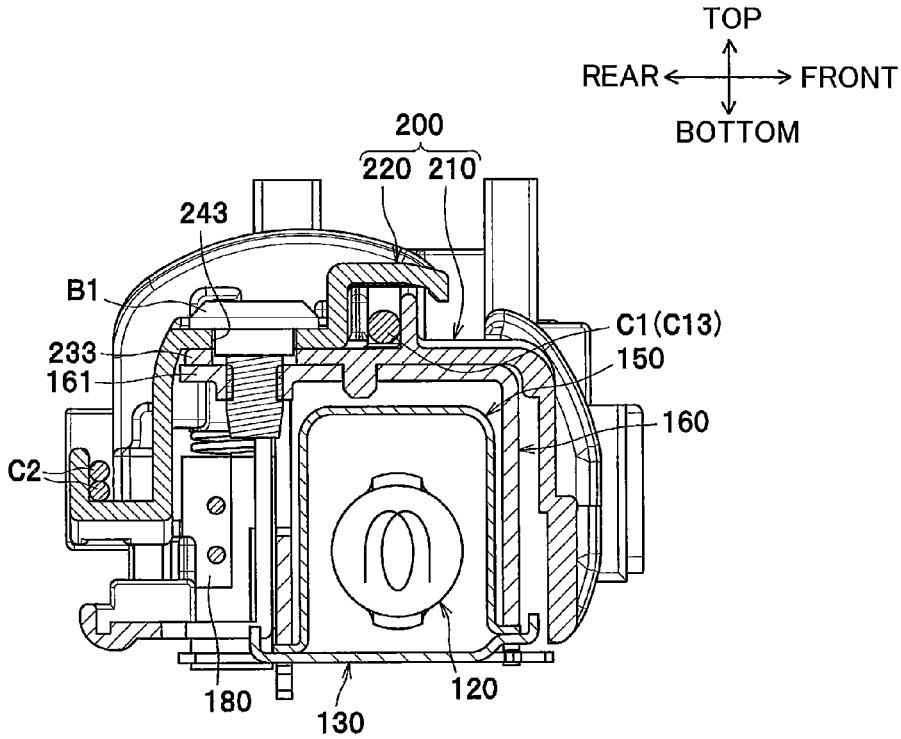
FIG. 6A is a cross-sectional view of the fixing device taken along a plane in which the right fixing portion is included.

Subsequently, as shown in FIG. 6A, a screw B1 is inserted into the circular hole 243 of the second frame 220 and the through-hole formed on the first frame 210 (the fixing portion 233) so that the screw B1 is screwed into the screw hole of the right fixing portion 161 of the stay 160 for threadingly engaging the stay 160 with the frame 200. The first frame 210 and the second frame 220 (the frame 200) are thus securely threadingly fixed to the stay 160 by the screw B1. In other words, a right end portion of the frame 200 is fixedly positioned relative to the stay 160 (or the screw B1) in the left-to-right direction (in the axial direction).

Figure 6B:
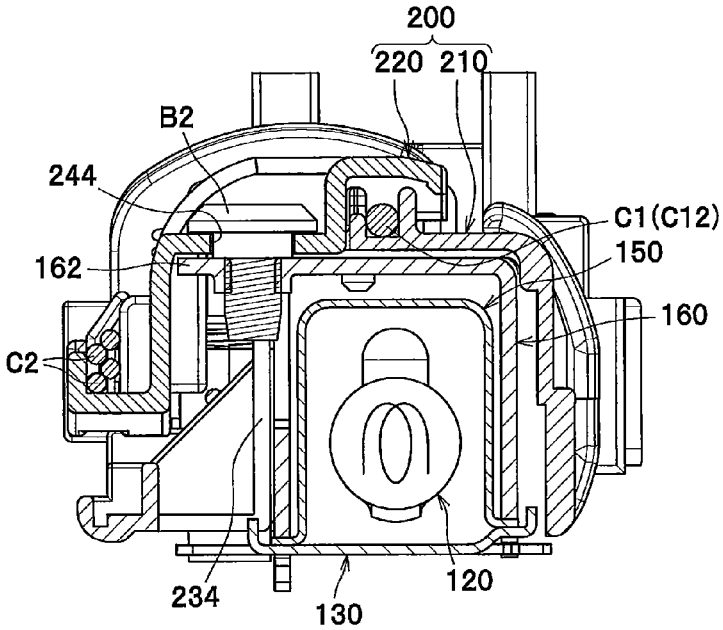
FIG. 6B is a cross-sectional view of the fixing device taken along a plane in which the left fixing portion is included.

Then as shown in FIG. 6B, a screw B2 is inserted into the oblong hole 244 of the second frame 220 and the cutout portion 234 of the first frame 210 such that the screw B2 is screwed into the screw hole of the right fixing portion 161 of the stay 160 for threadingly engaging the stay 160 with the frame 200. Note that the cutout portion 234 has a length larger than that of the left fixing portion 162 and the oblong hole 244 is elongated in the left-to-right direction, as described earlier. Therefore, while the frame 200 is securely fixed to the stay 160 with the screws B1 and B2, a left end portion of the frame 200 is permitted to move (to be displaced) in the left-to-right direction relative to the screw B2 that fixes the left end portion of the frame 200 to the stay 160.

In this way, the frame 200 is fixed to the stay 160 such that the right end portion is securely positioned with the screw B1, while the left end portion is loosely fixed relative to the screw B2 for allowing the left end portion to be displaced relative to the screw B2. Hence, even if linear expansion occurs at the stay 160 or at the frame 200 due to transmission of heat from the halogen lamp 120, the expansion can be absorbed. Hence, the stay 160 and the frame 200 can be suppressed from being deformed.

As described above, the stay 160, the thermostat 170, the thermistors 180, the coil springs 191, 192 and the frame 200 are assembled to one another. That is, to the stay 160, (1) the first frame 210, (2) the thermostat 170 and the thermistors 180, (3) the frame 200 that supports the coil springs 191, 192 are sequentially assembled in the order of (1), (2) and (3). With this construction, assembly is facilitated compared to a configuration where the thermostat 170 and the coil spring 191 and others are respectively assembled to a single support member (a single frame).

As shown in FIG. 4, the frame 200 is further formed with a plurality of guide portions that slidingly contacts the inner peripheral surface of the fusing belt 110 for guiding circular movement of the fusing belt 110. Specifically, the frame 200 includes, as the guide portions, the upstream guide 310, the downstream guide 320, the upper guides 330 and the front guide 340.

The upstream guide 310 is adapted to guide the fusing belt 110 toward the nip region N between the nip plate 130 and the pressure roller 140. The upstream guide 310 is formed at a bottom end portion of the front wall 212 of the first frame 210. More specifically, referring to FIG. 4, the upstream guide 310 is formed at a position adjacent to and immediately upstream of an upstream end portion 130F of the nip plate 130 in a direction in which the fusing belt 110 circularly moves (a clockwise direction in FIG. 4, and to be referred to as a moving direction of the fusing belt 110 hereinafter). The upstream guide 310 has a curved cross-section that protrudes toward the inner peripheral surface of the fusing belt 110.

Figure 7:
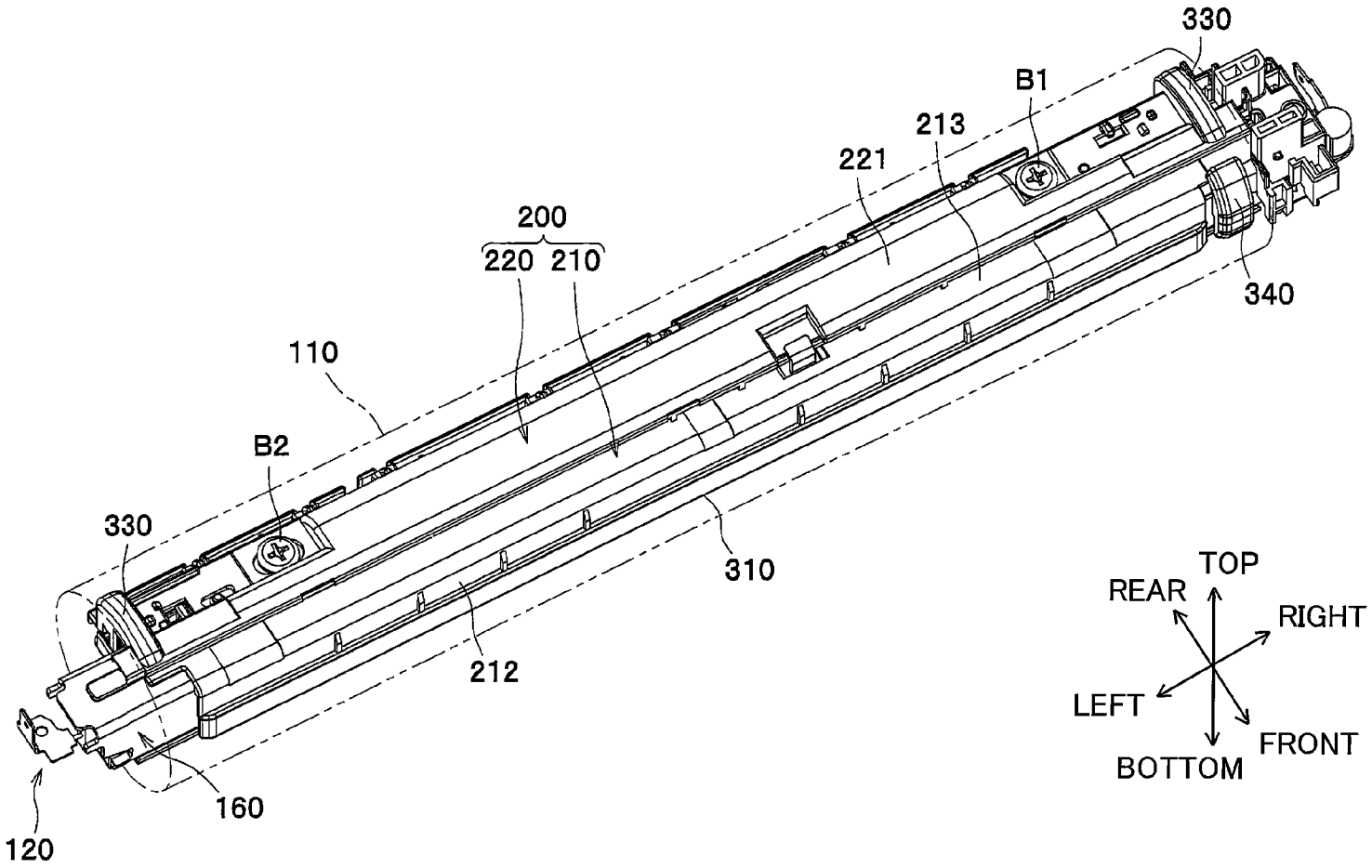
FIG. 7 is a perspective view of the first frame and the second frame assembled to each other as viewed from a front side.

As shown in FIG. 7, the upstream guide 310 extends in the left-to-right direction (axial direction) so as to cover a substantially entire length of the fusing belt 110. Due to the upstream guide 310, the fusing belt 110 can be smoothly guided toward the nip region N between the nip plate 130 and the pressure roller 140.

The downstream guide 320 is adapted to guide the fusing belt 110 coming out of the nip region N between the nip plate 130 and the pressure roller 140. The downstream guide 320 is formed at a rear end portion of the supporting wall 214 of the first frame 210 (i.e., at the isolating portion). More specifically, the downstream guide 320 is formed at a position adjacent to and immediately downstream of a downstream end portion 130R of the nip plate 130 in the moving direction of the fusing belt 110. The downstream guide 320 has a curved cross-section that protrudes toward the inner peripheral surface of the fusing belt 110.

In the present embodiment, the downstream guide 320 is formed to intermittently extend in the left-to-right direction, as shown in FIGS. 3 and 5. However, the downstream guide 320 may be formed to span almost the entire length of the fusing belt 110, just as the upstream guide 310. The downstream guide 320 allows the fusing belt 110 coming out of the nip region N to stably move.

Here, "immediately upstream" means that no other guide portion is disposed between the upstream guide 310 and the nip plate 130 in the moving direction of the fusing belt 110 for guiding the circular movement of the fusing belt 110. Similarly, "immediately downstream" means that no other guide portion is disposed between the nip plate 130 and the downstream guide 320 in the moving direction of the fusing belt 110 for guiding the circular movement of the fusing belt 110.

The upper guides 330 are adapted to guide an upper portion of the fusing belt 110. As shown in FIGS. 3 and 4, the upper guides 330 are formed on the upper wall 221 of the second frame 220 which is disposed at a side (upper side) opposite to the nip plate 130 (lower side) with respect to the halogen lamp 120. In other words, the upper guides 330 are formed at the isolating portion.

More specifically, the upper guides 330 are formed on widthwise end portions of the upper wall 221 in the axial direction, as shown in FIG. 7. Each upper guide 330 is formed to protrude upward from each widthwise end portion of the upper wall 221, and has a curved cross-section in a side view projecting toward the inner peripheral surface of the fusing belt 110 (see FIG. 4).

The front guide 340 is adapted to guide a front portion of the fusing belt 110. The front guide 340 is formed at the front wall 212 of the first frame 210. More specifically, the front guide 340 is formed at a right end portion of the front wall 212 such that the front guide 340 protrudes frontward. The front guide 340 has a curved cross-section in a side view projecting toward the inner peripheral surface of the fusing belt 110 (see FIG. 4).

The upper guide 330 and the inner peripheral surface of the fusing belt 110 are in contact with each other with a prescribed region. In FIG. 4, a chain line PL represents a plane that contacts a downstream end of the prescribed region in the moving direction of the fusing belt 110. The front guide 340 is disposed below this plane PL (at a side the same as that of the halogen lamp 120 with respect to the plane PL).

With this arrangement of the front guide 340, although a gap is formed between the upper guide 330 formed on the second frame 220 and the front guide 340 formed on the first frame 210, the fusing belt 110 can be smoothly guided from the upper guides 330 toward the front guide 340.

In the embodiment, due to the upper guides 330 and the front guide 340, the fusing belt 110 is permitted to circularly move smoothly and stably at the upper and front portions of the second frame 220. Further, the upper guides 330 are formed only on the widthwise end portions of the frame 200 (the second frame 220), while the front guide 340 is formed only on the right end portion of the frame 200 (the first frame 210). Therefore, smaller sliding resistance is generated between the inner peripheral surface of the fusing belt 110 and the upper guides 330, and between the inner peripheral surface of the fusing belt 110 and the front guide 340. As a result, the fusing belt 110 can smoothly circularly move.

As described above, in the fixing device 100 according to the embodiment, the frame 200 supporting the electric components (the thermostat 170, the cables C1, C2 etc.) is formed with the isolating portions (the supporting wall 214, the sectional walls 215, 216, the upper wall 221 and the ribs 246).

Therefore, contact between the fusing belt 110 and the electric components disposed at the internal space of the fusing belt 110 can be suppressed.

Further, due to the guide portions formed on the frame 200 (the upstream guide 310, the downstream guide 320, the upper guide 330 and the front guide 340), circular movement of the fusing belt 110 can be stable. Moreover, since the portions are formed on the frame 200, there is no need to provide a guide member separate from the frame 200. Therefore, a number of parts required to constitute the fixing device 100 can be reduced, thereby realizing the fixing device 100 to be compact.

Further, in the embodiment, the downstream guide 320 and the upper guide 330 are respectively formed on the isolating portions (the supporting wall 214 and the upper wall 221), which are likely to be in contact with the fusing belt 110. Hence, contact between the fusing belt 110 and the electric components can be suppressed, while stable circular movement of the fusing belt 110 can be achieved.

Further, the upper wall 221 as the isolating portion is disposed between the cable C1 and the fusing belt 110 so as to substantially cover the cable C1. Hence, contact between the fusing belt 110 and the cable C1 can be reliably suppressed (prevented).

More specifically, the cable C1 is disposed between the first frame 210 and the second frame 220, and, as viewed externally, the cable C1 is covered with the second frame 220. Further, the upper guide 330 is formed on the second frame 220 that covering the cable C1. Therefore, the contact between the fusing belt 110 and the cable C1 can be reliably suppressed, while the fusing belt 110 is allowed to circularly movable more smoothly.

Further, the guide portions are formed on the frame 200 which is fixed to the highly rigid stay 160 in the embodiment. As a result, the frame 200 can be stably positioned, leading to stable movement of the fusing belt 110.

In the embodiment, the thermostat 170 and the thermistors 180 as the electric components have cross-sectional areas greater than those of the cables C1, C2. Hence, when the thermostat 170 and the thermistors 180 are disposed at the internal space of the fusing belt 110, there arises a possibility that the fusing belt 110 may move (deform) closer to the thermostat 170 and the thermistors 180 and may be in contact with the same. To this effect, the above-described configuration of the present embodiment in which the isolating portions are formed between the electric components and the fusing belt 110 is especially effective in employing an electrical component having a relatively large cross-sectional area.

Further, in the embodiment, the electric components such as the thermostat 170 and the cables C1, C2 are disposed at a side opposite to the halogen lamp 120 with respect to the first frame 210 and the stay 160. Heat from the halogen lamp 120 can thus be suppressed from being transmitted to the electric components. Heat resistance of the electric components is not required to be high and therefore, relatively inexpensive components can be employed as the electric components. As a result, low production costs can be achieved.

Various modifications are conceivable.

For example, as the isolating portion, the second frame 220 may be further formed with a wall for covering a rear side of the thermostat 170 (refer to FIG. 2). Alternatively, the isolating portions may be interposed between the fusing belt 110 and the electric components to cover the electric components, just as the upper wall 221, or between the fusing belt 110 and portions of the electric components, just as the supporting wall 214 and the sectional walls 215, 216.

Further, as the guide portions, each rib 246 may be formed with a guide for guiding a rear portion of the fusing belt 110 (refer to FIG. 2). Alternatively, guide portions may be formed at the isolating portions, just like the downstream guide 320 and the upper guide 330, or at a portion of the frame 200 other than the isolating portions, just as the upstream guide 310 and the front guide 340.

Further, although the upper guides 330 (corresponding to the claimed second guide) are provided at both widthwise end portions of the fusing belt 110 in the axial direction in the embodiment, the second guide may be provided intermittently along the axial direction or may span the entire length of the fusing belt 110 in the axial direction.

In the embodiment, the guide portions are formed on both the first frame 210 and the second frame 220. However, in a configuration that one frame is totally covered with another frame, guide portions may be formed only on the another frame covering the one frame. Alternatively, when a frame member is configured of a plurality of frames, guide portions may be formed at least one of the plurality of frames.

The frame 200 of the present embodiment is formed with the ribs 235, 236, 245 and 246 so that the cables C1, C2 can be nipped between the ribs 235 and 236, and between the ribs 245 and 246 respectively. However, the frame 200 may be formed with grooves formed along the passages of the cables C1, C2. In this case, the cables C1, C2 are fitted in the grooves.

Further, the frame 200 may be fixed, not to the stay 160, but to a member configured to guide the widthwise end portions (end faces) of the circularly moving fusing belt 110 in the axial direction. Preferably, in order to make the circular movement of the fusing belt 110 stable, the frame 200 be fixed to a member having a high rigidity.

Further, in the present embodiment, the frame 200 is fixed to the stay 160 such that the right end portion of the frame 200 is positionally fixed relative to the stay 160, while the left end portion of the frame 200 is permitted to be displaced relative to the screw B2 (fastening screw) in the left-to-right direction. Instead, the frame 200 may be fixed to the stay 160 such that the frame 200 has a central portion that is positionally fixed relative to the stay 160 in the axial direction, while both widthwise end portions of the frame 200 are permitted to be displaced in the axial direction relative to respective fastening screws.

Further, the first frame 210 (corresponding to the claimed third frame) and the second frame 220 (corresponding to the claimed fourth frame) are fixed to the stay 160 with the common screws B1, B2 in the present embodiment. However, the third frame and the fourth frame may be respectively fixed to the stay 160 with separate screws.

Likewise, instead of the first frame 210 and the second frame 220 which are assembled to partially overlap with each other, one of the first frame 210 and the second frame 220 may completely cover the other when assembled and overlapped with each other.

The frame 200 may be configured of one member or more than three members.

In the depicted embodiment, the thermostat 170 and the thermistors 180 (as a temperature sensor) are configured to detect the temperature of the nip plate 130 (the first protruding portion 132 and the second protruding portions 133). Alternatively, the temperature sensor may be configured to detect a temperature of the inner peripheral surface of the fusing belt 110 (the tubular member). Here, it should be noted that, in the present embodiment, the temperature detecting surface of the temperature sensor may be or may not be in contact with its target for detection.

In the depicted embodiment, the thermostat 170, the thermistors 180 and the cable C1 are supported by the first frame 210, while the cable C2 is supported on the second frame 220. However, if the frame 200 is configured of a plurality of frames, electronic components may be supported to at least one of the plurality of frames.

Instead of the thermostat 170, a thermal fuse is also available as the electronic components.

Instead of the pressure roller 140, a belt-like pressure member is also available as the backup member.

Further, in the fixing device 100 of the present embodiment, the halogen lamp 120 (as the heater) is configured to heat the fusing belt 110 (as the tubular member) via the nip plate 130 (as the nip member). However, the heater may be configured to directly heat the tubular member.

In other words, the nip member is not necessary to be heated. If this is the case, the heater may be disposed at the internal space of the tubular member such that the heater is positioned at a side opposite to the nip member with respect to the stay.

Further, instead of the halogen lamp 120, a carbon heater or an IH heater may also be available as the heater.

Further, in the depicted embodiment, the fusing belt 110 (the tubular member) is made of a metal. Alternatively, the tubular member may be made from a resin such as a polyimide resin, or an elastic material such as a rubber. Still alternatively, the tubular member has a multi-layered structure. Specifically, the tubular member may be a metal belt whose surface is coated with a resin layer for reducing sliding resistance, or coated with an elastic layer such as a rubber.

Further, the reflection member 150 of the embodiment may be dispensed with. In this case, the stay 160 may have a reflection surface opposing the halogen lamp 120 for reflecting the radiant heat from the halogen lamp 120 toward the nip plate 130. In other words, the reflection member 150 and the stay 160 may be integrally formed with each other.

Further, the sheet S can be an OHP sheet instead of a plain paper and a postcard.

Further, in the depicted embodiment, the present invention is applied to the monochromatic laser printer 1 as an example of an image forming apparatus. However, the present invention may also be applicable to a color laser printer, and other image forming apparatuses such as a copying machine and a multifunction device provided with an image scanning device such as a flat head scanner.

While the invention has been described in detail with reference to the embodiments thereof, it would be apparent to those skilled in the art that various changes and modifications may be made therein without departing from the spirit of the invention.

What is claimed is:

1. A fixing device comprising:

an endless belt having an inner peripheral surface defining an internal space;

a nip member capable of being in contact with the inner peripheral surface of the endless belt;

a heater spaced apart from the nip member;

an electric component including a cable connected to the heater, the cable extending inside the internal space of the endless belt; and a frame for supporting at least a portion of the electric component, the frame comprising a guide portion configured to guide the inner peripheral surface of the endless belt.

2. The fixing device according to claim 1, further comprising a backup member, the nip member and the backup member being capable of nipping the endless belt therebetween to form a nip region between the backup member and the endless belt where a sheet is configured to be conveyed in a conveyance direction, wherein the guide portion includes a downstream guide disposed downstream in the conveyance direction relative to the nip region.

3. The fixing device according to claim 2, wherein the electric component further includes a thermostat, the thermostat being disposed upstream in the conveyance direction relative to the downstream guide.

4. The fixing device according to claim 3, wherein the thermostat is disposed downstream in the conveyance direction relative to the nip region.

5. The fixing device according to claim 2, wherein the cable of the electric component is disposed upstream in the conveyance direction relative to the downstream guide.

6. The fixing device according to claim 1, further comprising a backup member, the nip member and the backup member being capable of nipping the endless belt therebetween to form a nip region between the backup member and the endless belt where a sheet is configured to be conveyed in a conveyance direction, wherein the guide portion includes an upstream guide disposed upstream in the conveyance direction relative to the nip region.

7. The fixing device according to claim 6, wherein the electric component further includes a thermostat, the thermostat being disposed downstream in the conveyance direction relative to the upstream guide.

8. The fixing device according to claim 1, wherein the frame includes a first rib and a second rib spaced apart from the first rib, the cable being supported by the frame between the first rib and the second rib.

9. A fixing device comprising:

an endless belt having an inner peripheral surface defining an internal space;

a nip member capable of being in contact with the inner peripheral surface of the endless belt;

a heater spaced apart from the nip member;

an electric component including a cable, the cable extending inside the internal space of the endless belt; and a frame for supporting at least a portion of the electric component, the frame comprising a guide portion configured to guide the inner peripheral surface of the endless belt.

10. The fixing device according to claim 9, wherein the electric component further includes a thermistor.

11. The fixing device according to claim 10, wherein the cable includes a first cable extending from the thermistor and a second cable extending from the thermistor.

12. The fixing device according to claim 11, wherein the first cable extends from the thermistor in an extending direction, the second cable extending from the thermistor in the extending direction.

13. The fixing device according to claim 10, further comprising a backup member, the nip member and the backup member being capable of nipping the endless belt therebetween to form a nip region between the backup member and the endless belt where a sheet is configured to be conveyed in a conveyance direction, wherein the guide portion includes a downstream guide disposed downstream in the conveyance direction relative to the nip region.

14. The fixing device according to claim 13, wherein the thermistor is disposed upstream in the conveyance direction relative to the downstream guide.

15. The fixing device according to claim 14, wherein the thermistor is disposed downstream in the conveyance direction relative to the nip region.

16. The fixing device according to claim 13, wherein the cable of the electric component is disposed upstream in the conveyance direction relative to the downstream guide.

17. The fixing device according to claim 10, further comprising a backup member, the nip member and the backup member being capable of nipping the endless belt therebetween to form a nip region between the backup member and the endless belt where a sheet is configured to be conveyed in a conveyance direction, wherein the guide portion includes an upstream guide disposed upstream in the conveyance direction relative to the nip region.

18. The fixing device according to claim 17, wherein the thermistor is disposed downstream in the conveyance direction relative to the upstream guide.

19. The fixing device according to claim 17, wherein the thermistor is disposed downstream in the conveyance direction relative to the nip region.

20. The fixing device according to claim 9, wherein the frame includes a first rib and a second rib spaced apart from the first rib, the cable being supported by the frame between the first rib and the second rib.

* * * * *